US006578297B1

(12) United States Patent
Forsberg

(10) Patent No.: US 6,578,297 B1
(45) Date of Patent: Jun. 17, 2003

(54) SKID STEER ATTACHMENT, SUB-ATTACHMENT SYSTEM HAVING EXTENDED REACH

(76) Inventor: Craig H. Forsberg, c/o Snipe USA LLC, 20788 Aberdeen Ave., Jordan, MN (US) 55352

( * ) Notice: Subject to any disclaimer, the term of this patent is extended or adjusted under 35 U.S.C. 154(b) by 0 days.

(21) Appl. No.: 09/621,174

(22) Filed: Jul. 21, 2000

Related U.S. Application Data

(60) Provisional application No. 60/156,423, filed on Sep. 28, 1999.

(51) Int. Cl.[7] ..... E02F 3/40

(52) U.S. Cl. ..... 37/444; 37/405; 37/408; 37/403; 172/817; 414/724; 414/912; 414/722

(58) Field of Search ..... 37/403, 405, 404, 37/444, 901, 468, 408; 414/912, 723, 724, 722; 172/817, 245, 250, 253

(56) References Cited

U.S. PATENT DOCUMENTS

| | | | | |
|---|---|---|---|---|
| 2,657,481 | A | * | 11/1953 | Larsen |
| 2,860,794 | A | * | 11/1958 | Paluck |
| 3,145,488 | A | | 8/1964 | French |
| 3,305,952 | A | * | 2/1967 | Dressler |
| 3,458,069 | A | | 7/1969 | Wickberg et al. |
| 3,834,567 | A | * | 9/1974 | Miller |
| 3,938,680 | A | | 2/1976 | Grimes |
| 4,056,205 | A | * | 11/1977 | Etzler, IV |
| 4,068,771 | A | * | 1/1978 | Zimmerman |
| 4,125,952 | A | * | 11/1978 | Jennings |
| 4,164,247 | A | | 8/1979 | Wolf |
| 4,208,814 | A | | 6/1980 | Stone |
| 4,242,035 | A | * | 12/1980 | Hornstein |
| 4,411,585 | A | * | 10/1983 | Quinn |
| 4,439,088 | A | | 3/1984 | Summa |
| 4,550,512 | A | | 11/1985 | Felstet |
| 5,261,171 | A | * | 11/1993 | Bishop |
| 5,273,375 | A | * | 12/1993 | Plourde |
| 5,692,875 | A | | 12/1997 | Boman |
| 5,901,479 | A | * | 5/1999 | Langdon |
| 5,940,996 | A | * | 8/1999 | Cummings |
| 6,000,152 | A | * | 12/1999 | Tate |
| 6,067,733 | A | * | 5/2000 | Gasper |
| 6,085,447 | A | * | 7/2000 | Rose |
| 6,092,606 | A | * | 7/2000 | Basler |
| 6,209,236 | B1 | * | 4/2001 | Omann |
| 6,230,424 | B1 | * | 5/2001 | Renski et al. |

FOREIGN PATENT DOCUMENTS

| | | | |
|---|---|---|---|
| DK | 86710 | * | 3/1959 |
| FR | 1240908 | * | 8/1960 |
| JP | 356025526 | * | 3/1981 |
| SU | 1745823 | * | 7/1992 |

OTHER PUBLICATIONS

Printout of Internet http://www.kascomfg.com/rooter.htm, 3 pages.
Printout from Kasco Manufacturing Co., Inc. website entitled Skid Steer Attachments dated Oct. 19, 2000.
Product brochure for The Snipe by Skid USA LLC.
Printout from Triple D Enterprises website entitled Triple D Product Information dated Jun. 18, 2001.

* cited by examiner

*Primary Examiner*—Victor Batson
(74) *Attorney, Agent, or Firm*—Patterson, Thuente, Skaar & Christensen, P.A.

(57) ABSTRACT

A unique bucket attachment and sub-attachment adaptable for use with skid steer loaders and other earth moving equipment. The bucket attachment has a much smaller ratio of width to length than conventional loader buckets. It also provides for a much longer reach than conventional loader implements. The bucket attachment is well adapted for use with a skid steer loader or other tractor for trenching, excavation and moving of granular materials such as earth, sand, gravel or crushed rock. The bucket attachment may include a short fork assembly at the distal end. In addition to increasing the reach of the attachment, the fork assembly assists in the manipulation of heavy unit items such as balled and burlapped trees and shrubs, boulders, and blocks of stone or concrete. Sub-attachments, such as a smaller bucket that further extends the reach of the bucket attachment, and a variety of chutes can be removably attached to the distal end of the bucket attachment.

26 Claims, 12 Drawing Sheets

W
L
10
12
16
20
20
22
24
26
28
36
36
50
52
54
56
60
60

SKID STEER ATTACHMENT, SUB-ATTACHMENT SYSTEM HAVING EXTENDED REACH

RELATED APPLICATION

This utility application claims the benefit of Provisional Application No. 60/156,423 filed Sep. 28, 1999, which is incorporated herein in its entirety by reference.

FIELD OF THE INVENTION

The present invention relates to the field of attachments for skid steerloaders and other power loaders having lift arms. In particular, it relates to an attachment for a skid steer loader especially adapted for lifting and placing loads at an extended distance from the loader.

BACKGROUND OF THE INVENTION

Landscaping involves the movement and manipulation of a variety of materials, most of which are heavy. Examples of one-piece items include plants with rootballs, boulders, stone blocks, concrete pavers and timbers. Flowable or granular materials such as earth, gravel, crushed stone, and sand also must be dug, or scooped, located and spread. Much of landscaping activity takes place in confined areas which are bounded by structures, fences, plantings or trees. Traditionally, therefore, these materials have been manipulated primarily by hand labor. Shovels, wheelbarrows and handcarts are often employed.

Versatile skid steer loaders have allowed landscapers to move many of these materials with less muscular effort, but loaders too have limitations. The standard bucket of a skid steer loader is about the same width as the machine or greater, typically from four to eight feet. Standard buckets can be readily used to move granular materials but tend to dump the materials in a pile as wide as the bucket. Often, it is necessary to fill wheelbarrows with flowable granular products for delivery to especially confined areas. A standard bucket is exceptionally poorly adapted for this task since it is much wider than the wheelbarrow. Thus, laborious hand shoveling is employed to fill wheelbarrows.

U.S. Pat. No. 4,068,771 to Zimmerman and U.S. Pat. No. 5,692,875 to Boman disclose devices that attach narrow chute-like assemblies to standard width loader buckets. These devices are necessarily limited in their reach by the ability of the loader to counterbalance the weight of the load. Additionally, the attachment of these devices seriously limits the utility of the loader bucket for other tasks and mostly precludes the handling of unit items as discussed below. In the case of Zimmerman, when the chute-like attachment is in place, the bucket can not be used for other purposes until the attachment is entirely removed. Boman includes a hydraulic chute swing mechanism but the chute remains above the bucket interfering with the carrying of items of any significant height.

A skid steer loader with a bucket may be employed to move plants, blocks, boulders, timbers and the like but individual items must often be manhandled into and out of the bucket. Substantial manual labor must be employed if the items are to be unloaded from a truck or trailer. A loader equipped with fork tines like those of a forklift may advantageously be used for such items. Depending on the design, however, these fork tines either make the bucket of the machine unusable until removed, or require the removal of the bucket for installation. In either case, valuable time and effort is expended in changing equipment.

Landscaping also requires the digging of holes and trenches for plantings, footings and the like. A skid steer tractor with a bucket can dig holes, but the hole is of necessity at least as wide as the bucket. Backhoe attachments capable of trenching are available but require considerable time to install and remove and severely limit maneuverability of the tractor when attached. Backhoe attachments are also expensive, complex, bulky and difficult to transport. Lastly, they must be removed before any other attachment can be employed.

Additionally, landscapers often mix small quantities of concrete by hand for setting fence posts and the like. It would be convenient to be able to raise the concrete mixing trough to a comfortable level and transport small portions of the heavy mix to the location of placement mechanically rather than by hand labor.

The landscaping industry would benefit greatly from an implement which could be used to handle and move both granular and unit materials, and deposit the materials at an extended distance from the loader. This implement should be simple, inexpensive, easily transported, and be inherently stable, even while carrying loads at an extended distance from the base of the loader. The use of this implement would significantly reduce the need for hand shoveling and laborious manipulation of heavy items commonly used in landscaping.

SUMMARY OF THE INVENTION

The invention hereof comprises a unique bucket attachment and sub-attachments adaptable for use with skid steer loaders and other small earth moving equipment. The bucket attachment has a much smaller ratio of width to length than conventional loader buckets. It also provides for a much longer reach than conventional loader implements. The bucket attachment is well adapted for use with a skid steer loader or tractor for trenching, excavation and moving of granular materials such as earth, sand, gravel or crushed rock. The bucket attachment can include a fork having short tines at the extreme end. In addition to increasing the reach of the attachment, the fork assists in the manipulation of heavy unit items such as balled and burlapped trees and shrubs, boulders, and blocks of stone or concrete.

The bucket attachment hereof successfully accommodates a number of competing design factors. Tractors such as skid steer loaders employ counterweights to balance the loads lifted by the lift arms. The moment arm of the counter weight is particularly limited by the need to keep the wheelbase of the loader short in order to facilitate steering in tight quarters. Without taking into consideration such factors, it would be possible to increase the reach of the bucket attachment to a point where the equipment was inherently unstable, or that it could no longer lift any significant load. Load characteristics also need to be accommodated. Unit objects typically are dense and compact but relatively small. Therefore, they do not limit the reach of the bucket attachment as much as do granular materials. A typical concrete retaining wall block weighs eighty to one hundred pounds. A large balled and burlapped tree or shrub may weight three hundred pounds. Crushed landscape stone weighs about 110 pounds per cubic foot. It can be seen that in order to carry a significant load of dense granular material safely it is desirable to keep the load as close to the front of the loader as possible. This is one reason why all loader buckets known to the applicant are configured with a ratio of width to length of about 2.5:1 or greater.

In order to keep the load of granular material as near to the front of the loader as possible, the bucket attachment hereof is beneficially shaped in a wedge shaped profile. In addition, there is a limit to the travel of the portion of the lift arm assembly that controls the pitch of the bucket relative to the tractor. It is desirable that heavy loads be carried close to the tractor and as low as possible. If it is desired to move the load to the rear of the elongate bucket it is preferred to join the attachment plate to the floor of the bucket at an acute angle. This allows the operator to tilt the bucket nose up to shift flowable, granular materials to the rear of the bucket.

In order to assure that the bucket attachment can be safely used it is helpful that the bucket attachment be self-limiting in load capacity. That is accomplished by limiting the width of the bucket itself. A ratio of width to length of about 0.30 to 0.38 is preferred. This also reduces the weight of the bucket, leaving more load capacity available. Additionally, the wedge shaped profile concentrates the weight of the attachment near to the tractor.

The fork assembly provides for ease of manipulation of blocks, boulders and the like. The fork tines are short and preferably limited to two and, unlike backhoe or excavator teeth, they are beveled upward so that the sharpest end is at the top. The fork assembly is preferably formed of one integral piece. This increases dexterity of manipulation and provides the added benefit of facilitating the spreading and grading of granular materials.

The bucket attachment hereof comprises an upright frame adapted for removable attachment to the lift arms of an earthmoving vehicle. This frame is integrated into the back plate of the bucket. The bottom plate and side plates are preferably formed of a single metal plate and are secured to the back plate forming an elongate bucket with approximately vertical sides, which is substantially constant in width from front to rear. Fork tines are attached to the front of the bucket assembly. The side plates of the bucket assembly may incorporate collars to receive a locking pin or pins that may be utilized to secure sub-attachments to the bucket attachment.

Sub-attachments may include a smaller mini-bucket which further extends the length and reach of the assembly. The mini-bucket may be attached to extend beyond the end of the fork and it can be especially advantageous if the capacity of the mini-bucket is about equal to that of a six cubic foot construction wheelbarrow. This allows the safe and easy filling of such wheelbarrows without laborious hand shoveling. The smaller size of the mini-bucket also provides a self limiting load feature so that the counterbalance of the tractor is not exceeded.

The mini-bucket may be secured to the bucket attachment by a simple pin passed through apertures on the bucket and the mini-bucket. Further, the mini-bucket may include hook assemblies that cause the apertures on the mini-bucket to align with the apertures on the bucket attachment to facilitate insertion of the locking pin. The hook assemblies also serve to transmit digging force from the bucket attachment to the mini-bucket and to hold down the front end of the mini-bucket relative to the bucket attachment.

A liner made of a durable nonstick material such as polyethylene may be incorporated into the bucket to facilitate the hand mixing of small quantities of concrete. The liner may be held in place by spring clips or other appropriate means to prevent it from inadvertently sliding out of the bucket during concrete pouring operations.

The size and weight of the bucket attachment allow it to fit readily into the rear of a pickup truck or van for transport. It is also small enough to be placed transversely on many trailers.

Sub-attachments can be constructed in a simple and economical manner since they do not require a large and expensive attachment plate to secure them to the bucket attachment. Sub-attachments may secure to the bucket attachment by being bolted in place of the fork assembly or by being held in place by a pin in a manner similar to the mini-bucket. Sub-attachments may include a bolt on chute in a straight or funnel shaped configuration, an extended digging bar, an extended length scraper adapted for pushing or pulling materials and a granular material chute held in place by a pin in a manner similar to the mini-bucket.

DETAILED DESCRIPTION OF THE INVENTION

Figure 1:
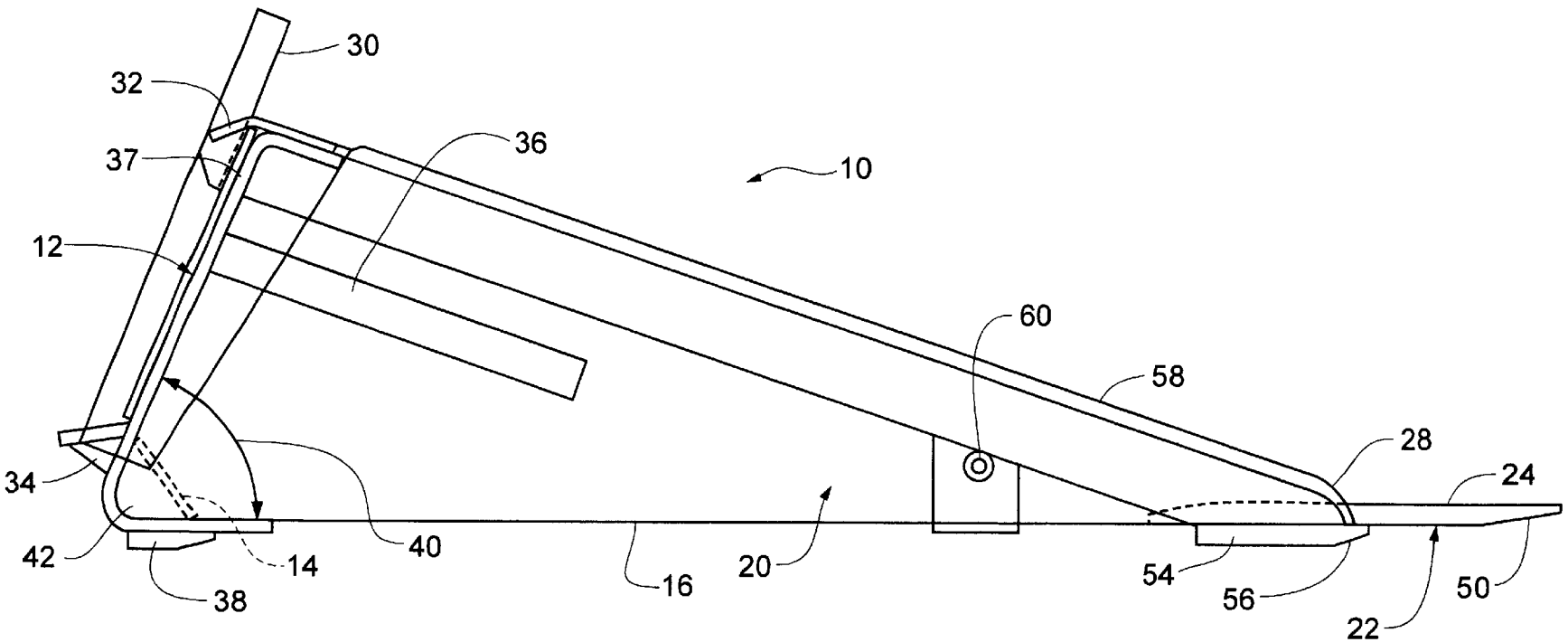
FIG. 1 is a side elevational view of a bucket attachment in accordance with the present invention.

Referring to the drawings, a bucket attachment 10, in accordance with the present invention, broadly includes a generally upright rear wall or attachment plate 12, a generally rectangular bottom 16, a pair of upright triangular forward tapering side walls 20 and a fork assembly 22 preferably of one piece having two tines 24. The bucket attachment 10 has a generally low wedge shaped side profile with the bottom 16 joined generally perpendicularly relative to the pair of side walls 20. The bottom 16 and the side walls 20 may be bent and formed of a single plate. The attachment plate/rear wall 12 is attached to the rear ends of the sidewalls 20 and bottom 16. Fork assembly 22 is secured to the nose end of the bucket attachment 10.

Figure 2:
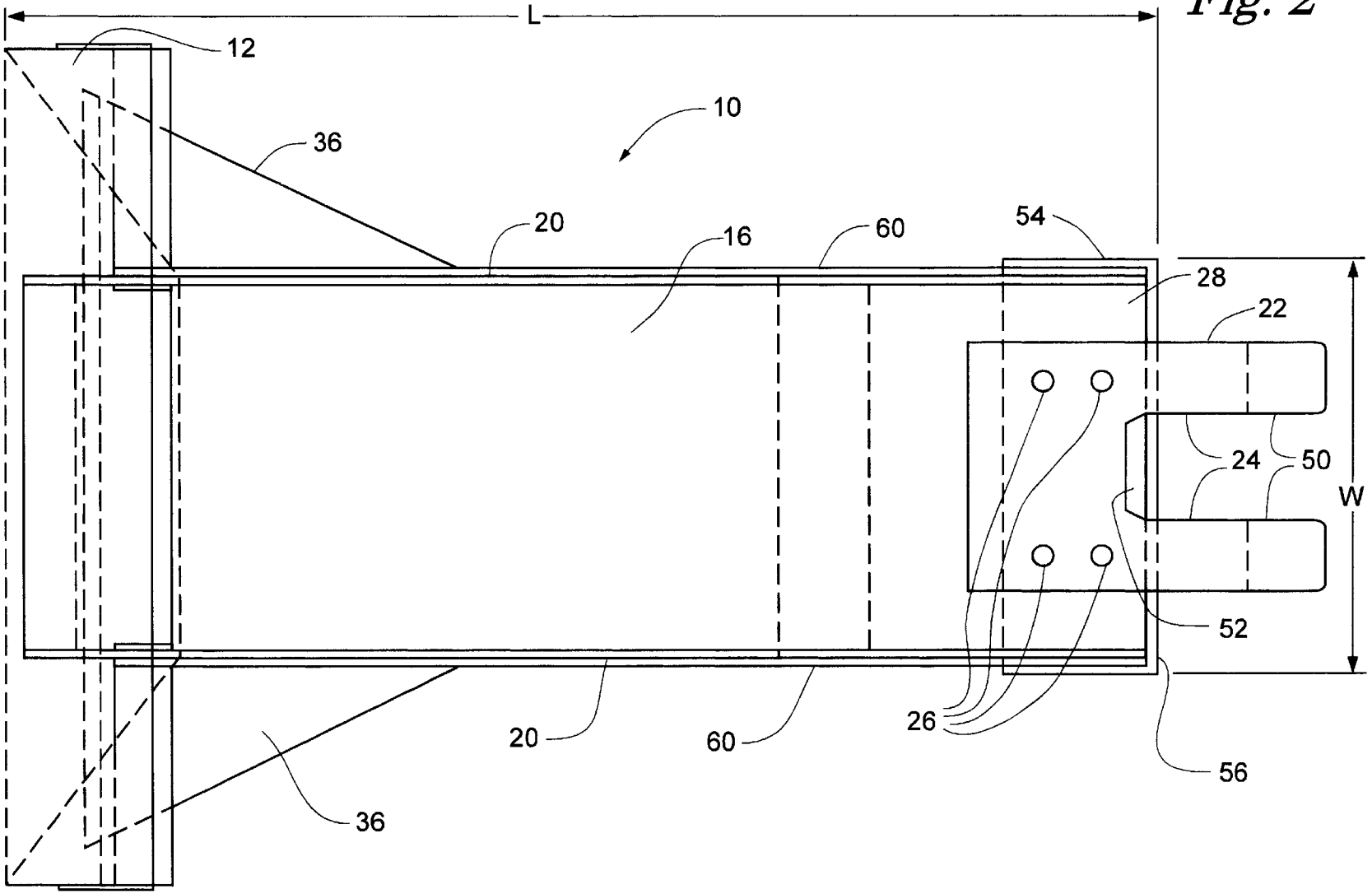
FIG. 2 is a top plan view of the bucket attachment.
Figure 4:
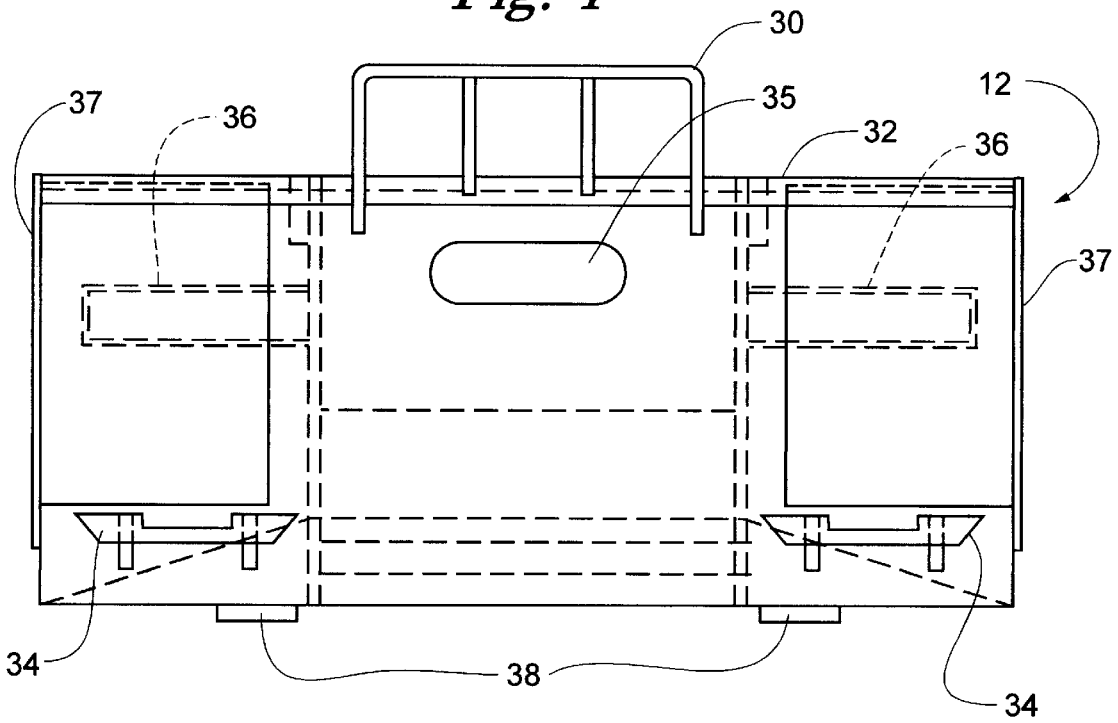
FIG. 4 is a rear elevational view of the attachment plate.

Referring particularly to FIG. 4, exemplary attachment plate 12 comprises an upper flange 32 and a pair of lower hookups 34. The attachment plate may be configured differently to adapt the bucket for attachment to different earthmovers. The attachment plate 12 may have a safety bar 30 affixed to the top edge thereof. Gussets 36 strengthen and stiffen the connection of attachment plate 12 connection to sidewalls 20. Gussets 36 may be flat plates as depicted in FIG. 1 or rectangular tubes as in FIG. 2. Risers 38 are secured to the bottom of attachment plate 12 and bottom plate 16. Safety bar 30 is a robust grid structure of vertical and horizontal bars secured to and extending above the attachment plate. Upper flange 32 extends across the upper edge of the attachment plate 12 and comprises a ridge protruding from the rear of attachment plate 12 angled downward at about thirty degrees. Hookups 34 each comprise pockets similarly angled downward at about thirty degrees. Aperture 35 extends through attachment plate 12 and has a racetrack configuration with the long axis generally horizontal. Side bars 37 reinforce the ends of upper flange 32.

Figure 3A:
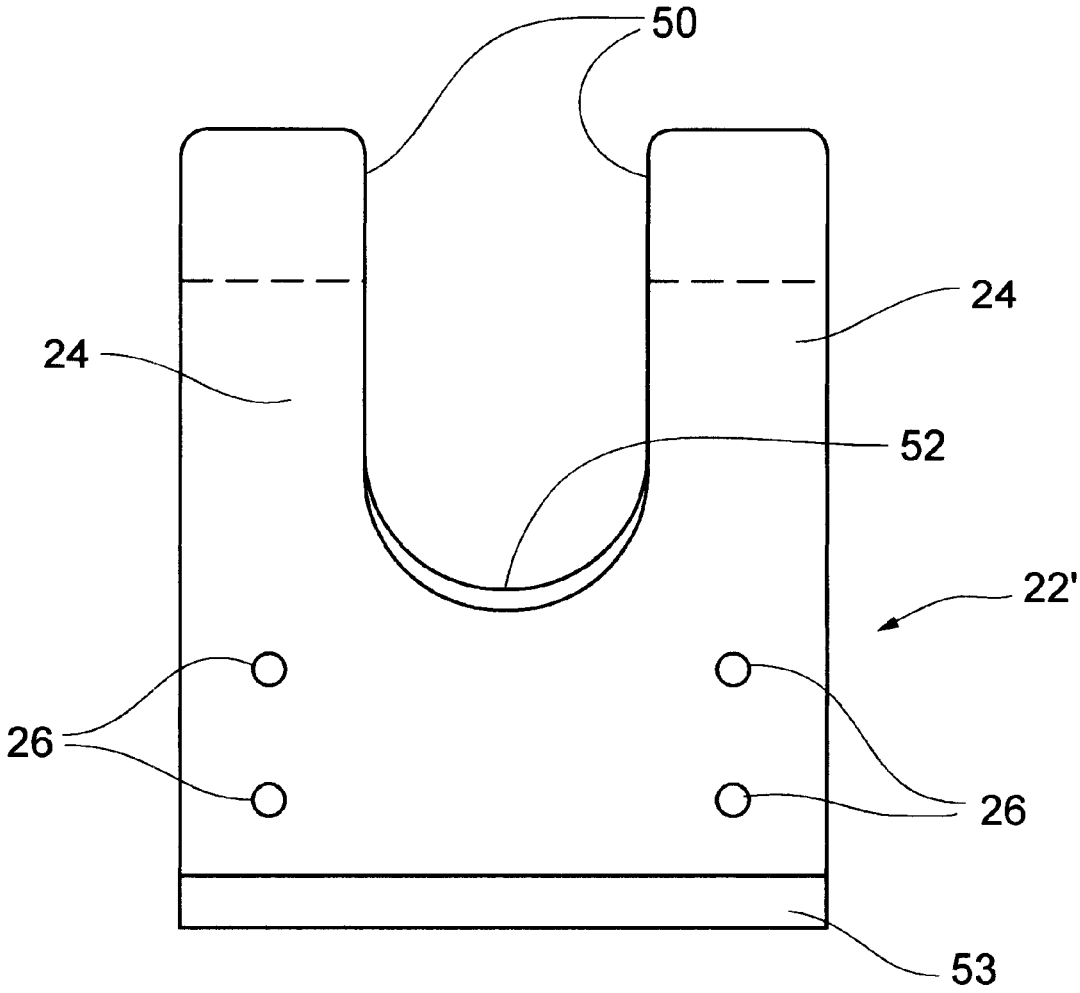
FIG. 3*a* is a top plan view of an alternate fork configuration.
Figure 3B:
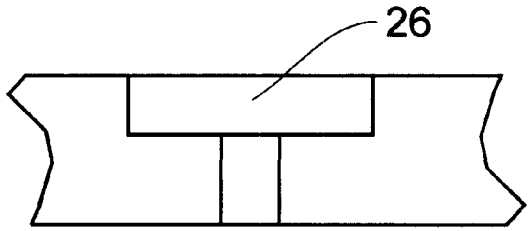
FIG. 3*b* is a sectional view of a recessed bolt hole as used in the fork assembly.
Figure 17:
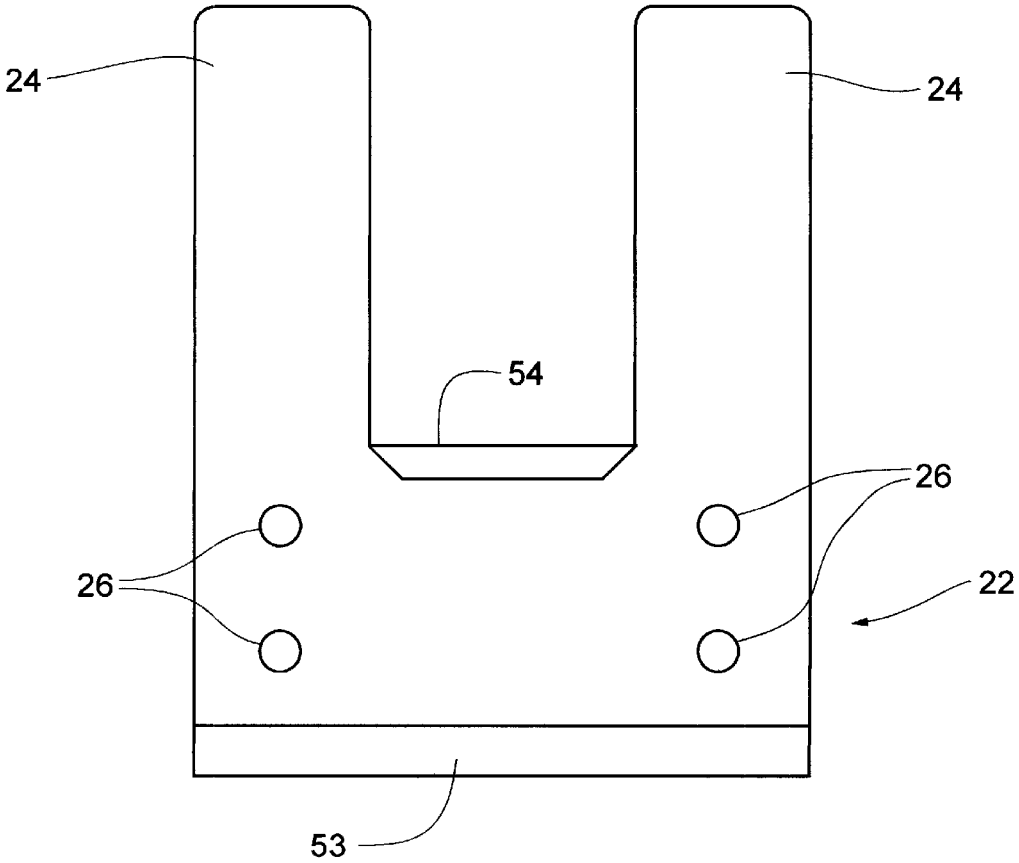
FIG. 17 is a top plan view of the fork assembly.
Figure 18:
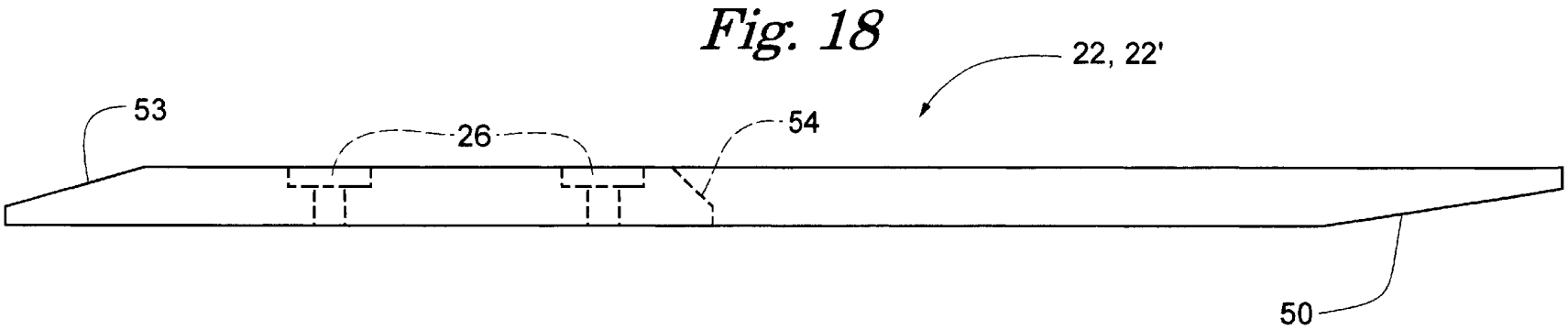
FIG. 18 is a side elevational view of the fork assembly.

Referring to FIGS. 3, 17 and 18, the fork assembly 22, 22' includes two tines 24 and is removably connected to the nose end of the bucket by nut and bolt assemblies 25 received through recessed bolt holes 26. The fork assembly 22 may be composed of two separate plates or, preferably, may be part of a single integral unit. The tines 24 may include beveled forward edges 50 which are beveled forwardly upward from their lower extremity. If the tines 24 are part of a single unit, the forward edge 52 of the portion of the fork assembly 22, 22' interposed between the tines has a similar upward beveled edge. Thus, the sharpest edges of fork assembly 22 are located at the upper forward edge. The forward edge 52 of the portion of the fork assembly 22, 22' between the tines may be curved as depicted in FIG. 3 or straight as depicted in FIG. 17. Fork assembly 22, 22' may include a beveled rear edge 53.

At least one grading bar 54 may be secured to the underside of the bottom of the bucket 10, also by nut and bolt assemblies 25 held in recessed bolt receiving holes 27, at or near to the nose end of the bucket 10. The grading bar or bars 54 preferably are beveled upward from their lower edges to create an angled edge 56. It is noted that the upward beveling at the nose edges of the bucket and grading bar 54, and fork assembly 22 is the opposite of that used on conventional earth moving equipment buckets and also the opposite of normal backhoe teeth.

Figure 6:
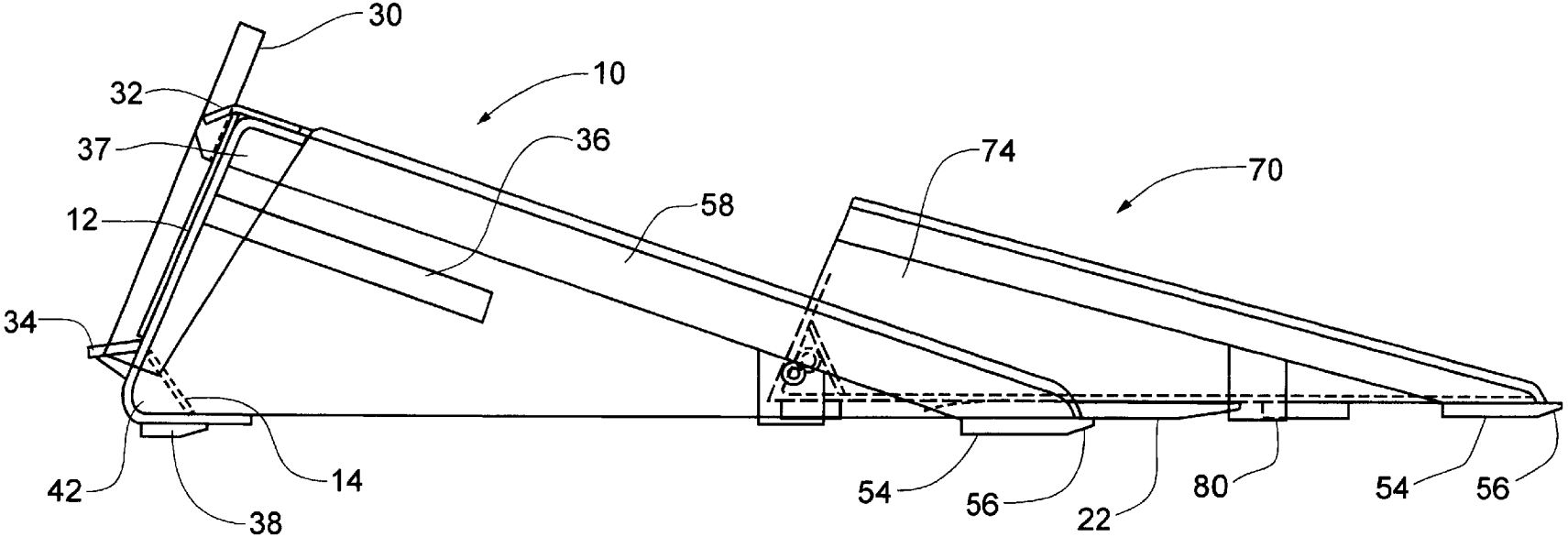
FIG. 6 is a side elevational view depicting the mini-bucket sub-attachment as secured to the bucket attachment.
Figure 7:
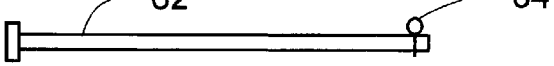
FIG. 7 depicts a locking pin.

Referring to FIGS. 1 and 6, the side rails 58 reinforce sidewalls 20 of the bucket attachment 10 and may also comprise collars 60 defining an opening in each side to receive a locking pin 62 to secure sub-attachments to the bucket 10. These collars 60 are preferably set back somewhat from the nose end 28 of the bucket 10.

Figure 5:
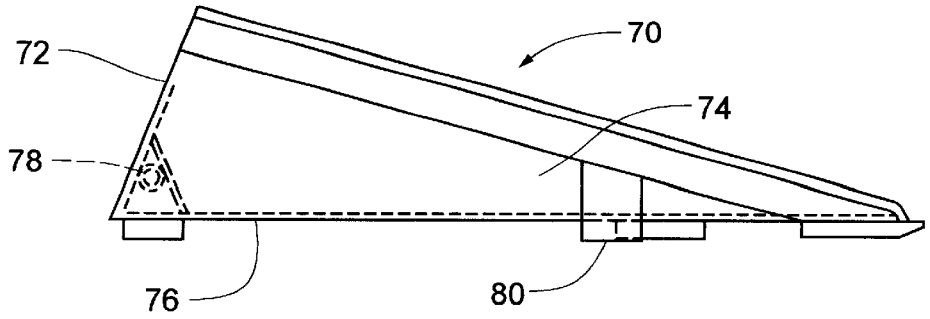
FIG. 5 is a side elevational view of a mini-bucket sub-attachment.

Mini-bucket sub-attachment 70 is depicted in FIGS. 5 and 6. The mini-bucket 70 has a generally upright rear wall 72 and triangular sidewalls 74 secured to generally rectangular bottom 76. It is sized to slip fit between the sides of the bucket attachment 10.

The mini-bucket further comprises a latching mechanism 77 comprising a sleeve 78 to receive the pin 62 placed through the collars 60 of the bucket attachment 10 for selectively removably securing the mini-bucket in place. A lip or lips 80 may be placed on the underside of the mini-bucket. Lip 80 comprises a transverse plate with a rearwardly extending overhang defining a gap between the lip and the bottom 16 of the bucket attachment 10.

The locking pin 62 comprises a shaft, sized to fit through collars 60 and sleeve 78, an enlarged head 82 large enough to prevent the locking pin 62 from passing through collar 60, and a securing fastener 84 to prevent the other end of the pin 62 from passing through the other collar when in place. Fastener 84 may include a hairpin or safety pin type fastener and a bore through lock pin 62, a bolt and nut, a snap ring and circumferential groove in lock pin 62 or other appropriate fastener.

Figure 10A:
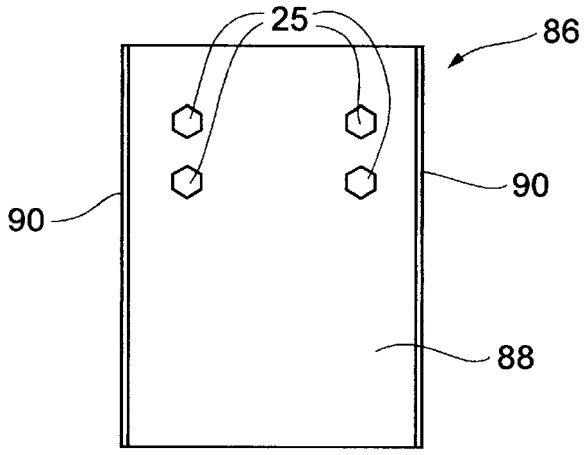
FIG. 10*a* is a top plan view of a chute sub-attachment.
Figure 10B:
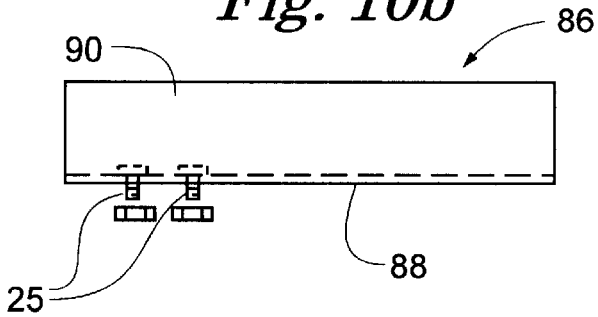
FIG. 10*b* is a side elevational view of the chute sub attachment.
Figure 11A:
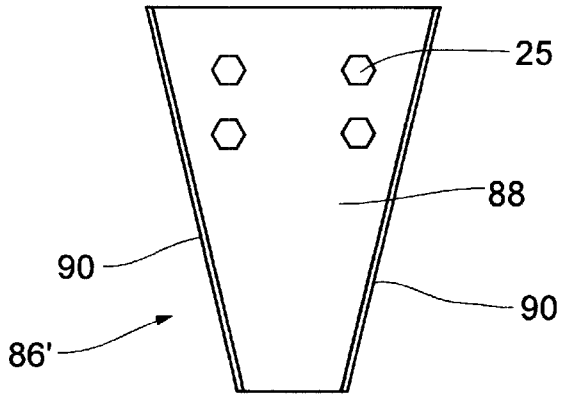
FIG. 11*a* is a top plan view of a funnel chute sub-attachment.
Figure 11B:
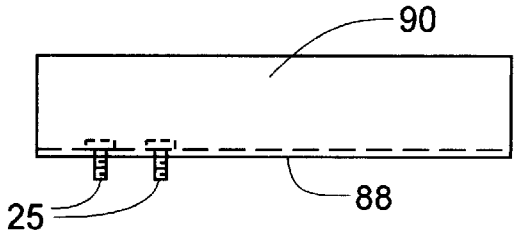
FIG. 11*b* is a side elevational view of the funnel chute sub attachment.
Figure 12B:
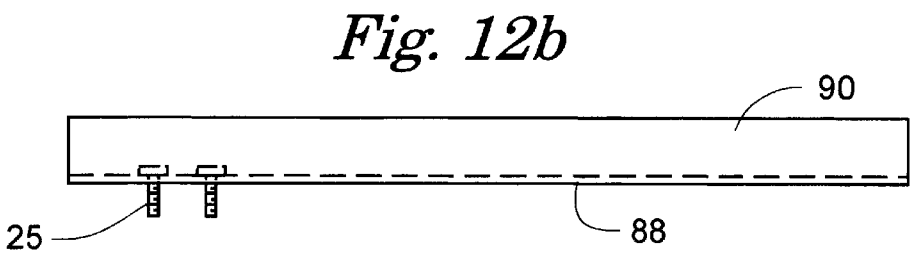
FIG. 12*b* is a side elevational view of the extended funnel chute sub attachment.
Figure 13A:
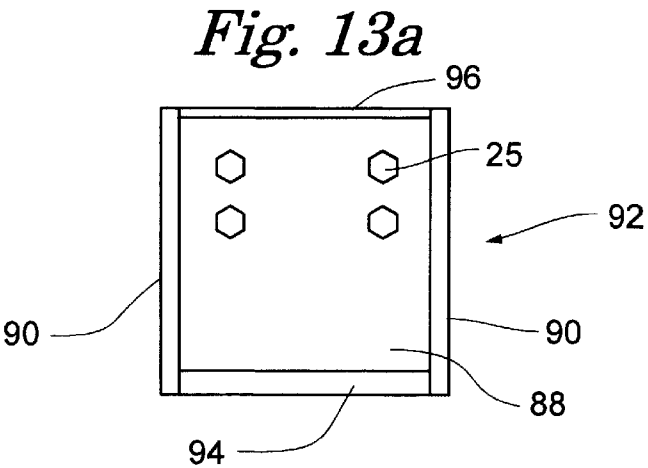
FIG. 13*a* is a top plan view of a digging bar sub-attachment.
Figure 13B:
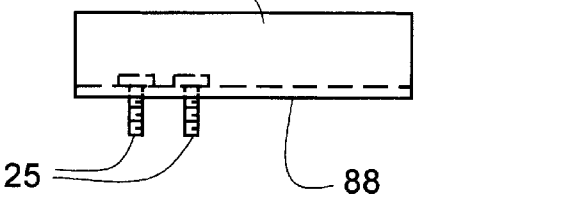
FIG. 13*b* is a side elevational view of the digging bar sub attachment.
Figure 12A:
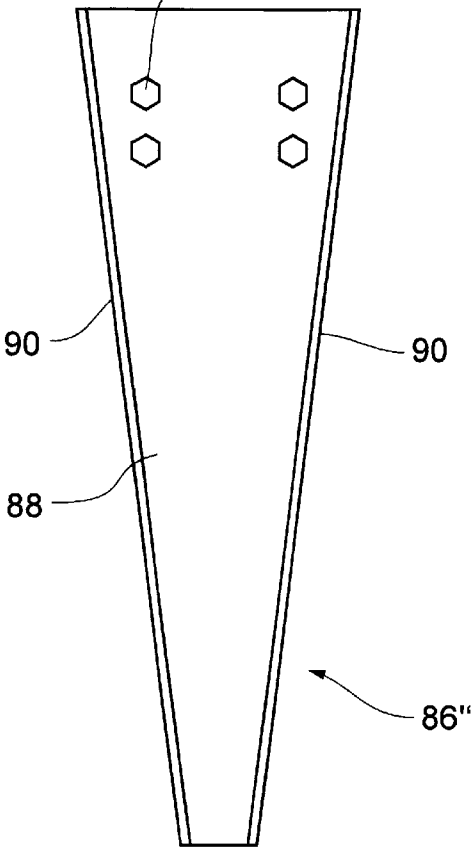
FIG. 12*a* is a top plan view of an extended funnel chute sub-attachment.

Other sub-attachments may be employed with bucket attachment 10. Some attach in a manner similar to that of mini bucket 70. Others may be bolted to the bucket attachment 10 in place of fork assembly 22. Referring to FIGS. 10, 11 and 12, several different embodiments of a bolt on chute sub-attachment are depicted. Referring particularly to FIG. 10, a bolt on chute sub-attachment 86 takes the form of a straight sided chute having a generally flat, rectangular bottom 88 and generally vertical sides 90. The chute sub-attachment 86 is secured to bucket attachment 10 by nut and bolt assemblies 25 after removal of fork assembly 22.

FIGS. 11 and 12 depict an alternative embodiment of chute sub-attachment 86. Funnel chute sub-attachment 86' is similar in construction to chute sub-attachment 86 aside from presenting a width tapering from approximately that of bucket attachment 10 at the rear to substantially less at the front thereof. Referring to FIG. 12, elongate funnel chute sub-attachment 86" presents a funnel shape similar to sub-attachment 86' but having a further extended reach.

Referring to FIG. 12, an extended digging bar 92 is depicted. The extended digging bar 92 is similar in structure to bolt on chute sub-attachment 86 but is made of a heavier material. Extended digging bar 92 also includes a beveled front edge 94 and a beveled rear edge 96. Extended digging bar 92 may be bolted to bucket attachment 10 in place of fork assembly 22 by via nut and bolt assemblies 25.

Figure 14A:
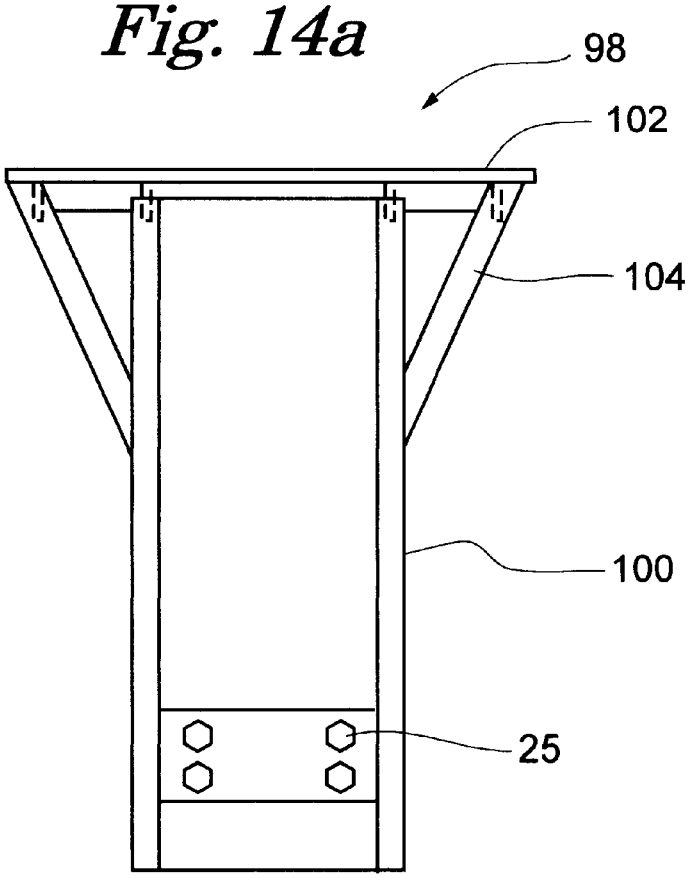
FIG. 14*a* is a top plan view of a scraper sub-attachment.
Figure 14B:
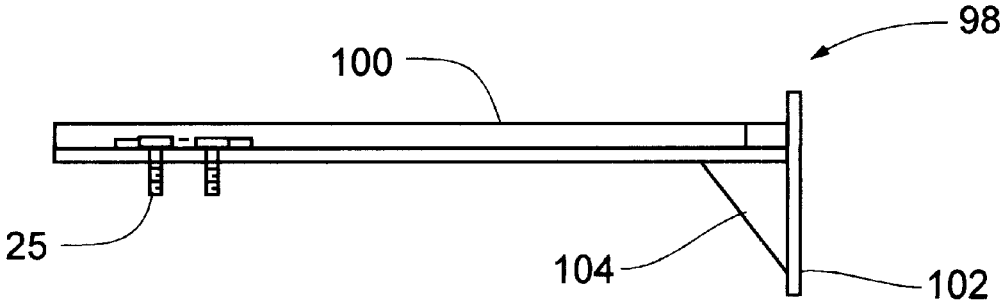
FIG. 14*b* is a side elevational view of the scraper sub attachment.

Referring to FIG. 14 a scraper sub-attachment 98 is depicted. Scraper sub-attachment 98 includes an extended support 100, a scraping member 102, and reinforcing gussets 104. Scraping plate 102 is connected to the end of extended support 100 in a generally perpendicular orientation. Scraper 98 may be attached to bucket attachment 10 in place of fork assembly 22 via nut and bolt assemblies 25.

Figure 15A:
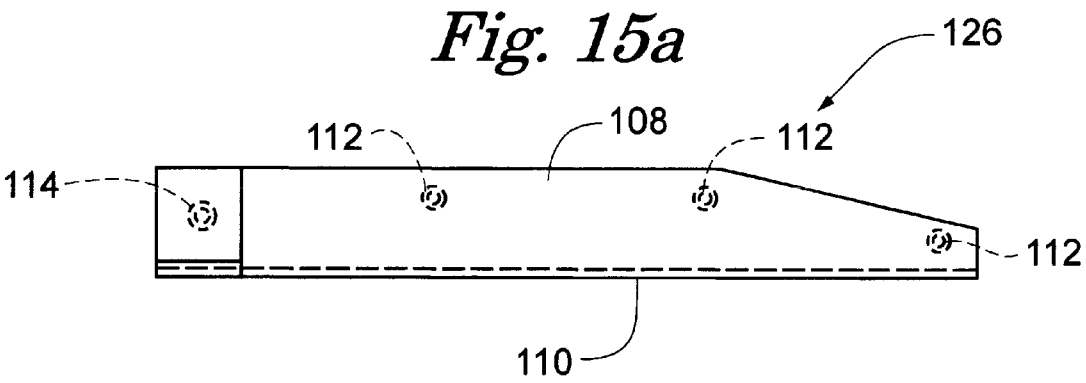
FIG. 15*a* is a side elevational view of an alternate embodiment of the chute sub attachment.
Figure 15B:
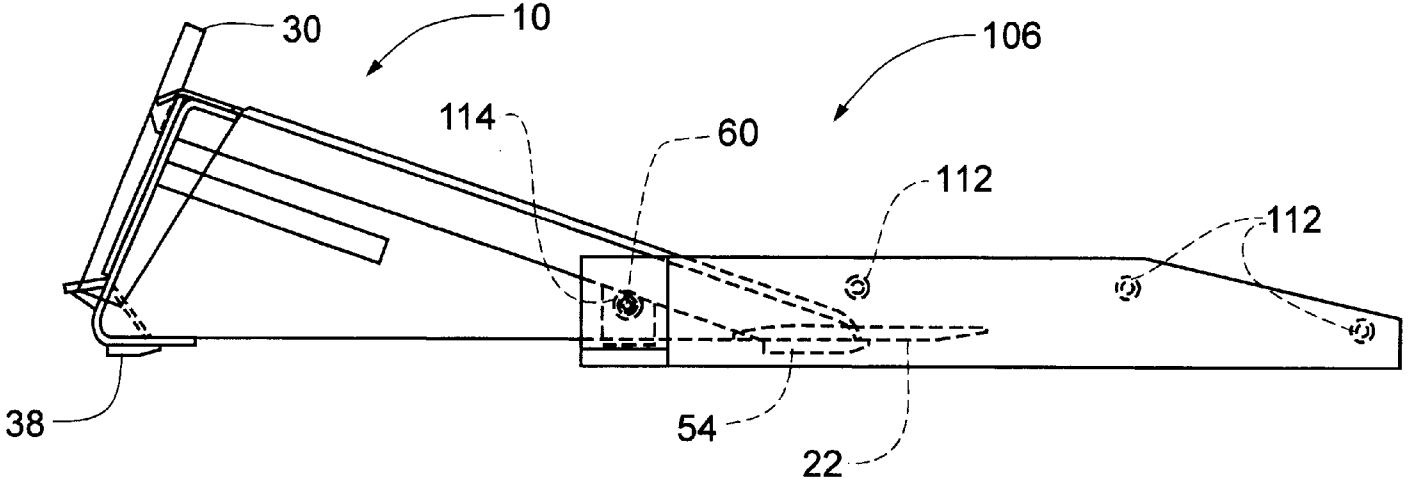
FIG. 15*b* is a side elevational view depicting the alternate chute sub-attachment as secured to the bucket attachment.

Referring to FIG. 15 a further sub-attachment is depicted. Rock chute 106 generally includes side plates 108 rising generally vertically from bottom 110. Transverse braces 112 extend transversely interconnecting opposed side plates 108. Each of opposed side plates 108 further include a collar 114 passing through reinforcement plate 116. Collars 114 are positioned so as to be alignable with collars 60 on bucket attachment 10. Collars 114 are further sized appropriately to receive locking pin 62 therethrough.

Figure 16:
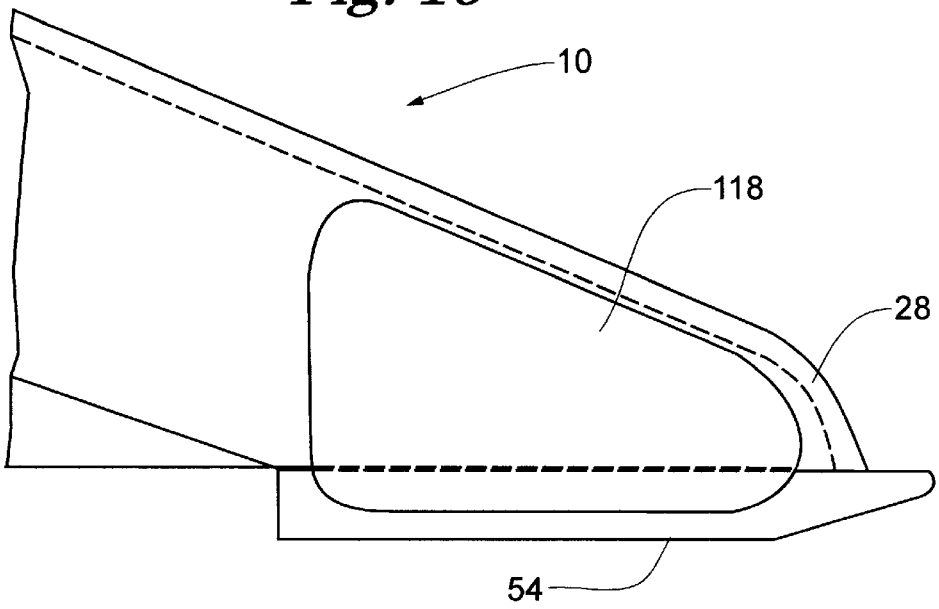
FIG. 16 is a fragmentary side elevational view of an alternate embodiment of the bucket attachment including a nose brace.

Referring to FIG. 16, an alternative construction of bucket attachment 10 includes nose brace 118. Note that alternative nose brace 118 reinforces each side of the nose of bucket attachment 10 as well as partially enclosing the ends of grading bar 54.

The width of the bucket attachment 10 is substantially uniform and relatively quite narrow as compared to conventional bucket attachments. Preferably, the width of the bucket, not including the mounting plate, is between fifteen and thirty inches, optimally about twenty-three inches. The rear wall 12 and bottom 16 of the bucket attachment preferably meet at an acute angle 40. Most preferred is an angle of about seventy two degrees. An angled inside plate 14 may be secured into the acute corner 42 formed by the rear wall 12 and bottom 16. Bottom 16 is generally rectangular in shape with the longer axis of the rectangle having length L positioned orthogonal to the attachment plate 12. The shorter axis of the rectangular bottom 16 having width W is generally parallel to rear wall 12.

In order for the bucket attachment to have a longer reach than conventional buckets and to assure that the bucket attachment can be safely used it is helpful that the bucket attachment be self-limiting in load capacity. This is accomplished by limiting the width of the bucket itself. A ratio of width to length of about 0.30 to 0.38 is preferred. This also reduces the weight of the bucket, leaving more load capacity available. Additionally, the wedge shaped profile concentrates the weight of the attachment and load near to the loader so as not to overbalance the counterweight.

As noted above, the bucket attachment 10 has a much smaller ratio of width W to length L than conventional loader buckets. It also provides for a greater length L than conventional loader implements. The length L of the bucket attachment 10 (exclusive of the fork assembly 22) can range from thirty to one hundred inches, and preferably is about sixty two inches. The ratio of width W to length L for the bucket attachment is less than about 0.50. Optimally, the ratio of width to length is about 0.30 to 0.38.

Figure 8:
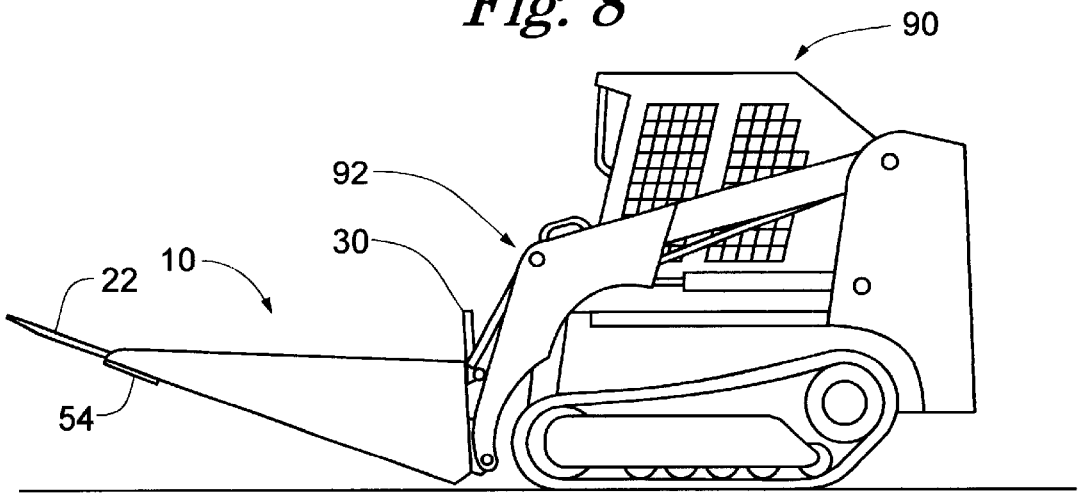
FIG. 8 depicts bucket attachment attached to skid steer loader with the bucket attachment in a load carrying configuration.
Figure 9:
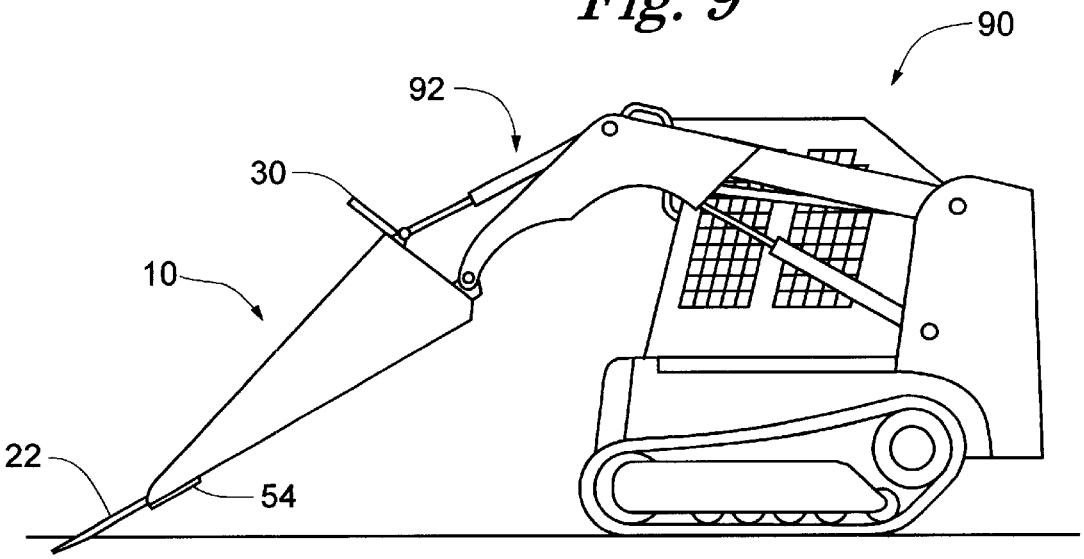
FIG. 9 is similar to FIG. 8 but with the bucket attachment in a working configuration.

In operation, and referring to FIGS. 8 and 9, the skid steer loader or tractor 90 is positioned so that the lift arms 92 of the loader are in contact with the attachment plate 12. The hookups 34 and the upper flange 32 are engaged by the attachment mechanism at the end of the loader lift arms to raise and manipulate the bucket attachment. A locking mechanism secures the lift arms to the attachment plate. In operation the bucket attachment 10 is removably attached to a skid steer loader 90, and is used to dig, trench, spread granular materials, and manipulate unit items.

Referring to FIG. 8, the skid steer loader 90 and bucket attachment 10 are depicted in a load carrying configuration. Note that a granular material load is held near to the front of the loader for stability. The fork assembly 22 is angled to cradle a unit load securely.

FIG. 9 depicts the bucket attachment 10 in a position that facilitates digging. The fork assembly 22 loosens packed soil to allow its removal with the bucket attachment 10. This position may also be employed for the unloading of flowable materials when a load is to be placed. A position (not shown) between that in FIG. 8 and FIG. 9 is used to pick up unit items on the fork assembly 22 and to use the fork assembly 22 and grading bar 54 to grade and smooth materials. A plurality of other operating positions will be apparent to those skilled in the art for placing and moving materials.

The safety bar 30 serves to prevent loads carried by the bucket attachment 10 from sliding rearward, passing over the attachment plate 12 and injuring the operator or damaging the tractor. The greater length and narrow width of the bucket attachment facilitates improved maneuverability and reach for the attachment in confined areas such as between boulders, trees and structures and over terraces and plantings. In particular, this allows the bucket attachment to reach over obstructions such as when reaching over a retaining wall to back fill behind it.

The acute angle 40 at which the attachment plate meets the bottom plate 16 provides the preferred angle of tilt for the bucket attachment to carry granular materials low and close to the center of gravity of the tractor as well as keeping unit items securely on the fork assembly. The angled inside plate 14 serves to increase strength and fill the acute comer 42 to prevent the compaction of granular materials into the rear of the bucket attachment 10.

The fork assembly 22, 22' facilitates the handling of heavy unit objects such as boulders, concrete items, balled and burlapped plants and the like. The fork ends 50 are beveled upward to ease the lifting of unit items and to facilitate the spreading and smoothing of granular materials. The upward bevel 50 of the fork assembly 22 and grading bars 54 moves gradable material down and away from the grading bar 54 and fork assembly 22, preventing the buildup of materials therebetween and making the bucket attachment especially useful in spreading and smoothing operations. The upward bevel 50 of the fork assembly 22 facilitates the lifting of unit objects by allowing the forks to slide under the unit object readily. The upward bevel 50 of the fork assembly 22 also loosens hard packed material for digging.

The bucket attachment 10 may include a locking device to releasably connect a sub-attachment such as mini-bucket 70 thereto. The mini-bucket 70 further extends the reach of the bucket attachment and is preferably sized to have a capacity equal to that of a standard six cubic foot wheelbarrow. This allows the easy and rapid filling of wheelbarrows to transport granular materials to extremely confined areas.

Other sub-attachments may be used in concert with the bucket attachment. Sub-attachments generally can be placed so that a pin 62 can be inserted through the collars and through collars 114 or sleeve 78 on the sub-attachments to secure the sub-attachments to the bucket attachment 10 quickly and easily. In practice, the sub-attachment is located within or outside of bucket attachment 10 and locking pin 62 is placed through the first collar 60, then through the sleeve 78 of the sub-attachment then through the second collar 60. A fastener 84 is then used to secure the locking pin 62 from unintentionally being retracted from the collars 60 and sleeve 78. Alternately, fork assembly 22 may be removed and a different sub-attachment bolted in its place.

The lip 80 of the mini-bucket sub-attachment may be hooked under the nose edge of the bucket attachment 10, the fork assembly 22, 22' to assist in securing the mini-bucket 70 to the bucket attachment 10. Note that lip 80 both prevents mini-bucket 70 from lifting relative to bucket attachment 10 and transmits digging force from fork assembly 22 to mini-bucket 70 along with pin 62. Lip 80 also aligns sleeve 78 with collars 60 to ease placement of pin 62 therethrough. Other means of securing the mini-bucket sub-attachment 70 to the bucket attachment 10 may be employed without departing from the scope of the invention. The mini-bucket 70 can then be used to place small quantities of granular material at a great distance from the tractor 90 or to fill a wheelbarrow easily.

A liner made of a durable nonstick material such as polyethylene may be incorporated into the bucket 10 to facilitate the hand mixing of small quantities of concrete. The liner may be held in place by spring clips or other appropriate connectors to prevent it from inadvertently sliding out of the bucket during concrete pouring operations.

Funnel chutes 86' and 86" may be used to fill postholes with gravel or concrete.

Scraper sub-attachment 98 may be employed to push or pull materials in difficult locations such as to spread gravel under a low deck or to remove weeds from the shoreline of a pond.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed is:

1. An attachment for a power loader, adapted for lifting and placing loads at an extended distance from the loader comprising, an attachment member adapted to attach said attachment to lift arms of said power loader; and a bucket, said bucket presenting an elongate axis extending generally outward away from said power loader in a digging direction and a shorter axis extending generally perpendicular to said elongate axis and said shorter axis being defined as the distance between opposed side plates at their widest separation, and said elongate axis being not less than twice as long as the shorter axis said bucket having a backwall operably coupled to said attachment member, a bottom plate, and said opposed side plates operably coupled to said backwall and to said bottom plate, said side plates extending upwardly from said bottom plate and outwardly from said backwall, said backwall forming an acute angle relative to said bottom plate, whereby, loads of dense flowable material may be carried near to said loader for stability by shifting said attachment to a load carrying position and still placed at an extended distance from the loader by shifting said attachment to an unloading position.

2. The attachment as claimed in claim 1, further comprising a sub-attachment, said sub-attachment comprising a bottom and a pair of separated opposed sides operably coupled to said bottom, said sub-attachment being adapted for removable connection to said attachment to further extend the distance from the loader at which loads of flowable material may be spread.

3. The attachment as claimed in claim 2, said sub-attachment bottom further comprising a beveled forward edge and a beveled rearward edge whereby digging may be facilitated.

4. The attachment as claimed in claim 2, said sub-attachment being removably connected to said attachment by threaded fasteners.

5. The attachment as claimed in claim 2, said sub-attachment being removably connected to said attachment by a pin and collar assembly.

6. The attachment as claimed in claim 1, further comprising a second bucket, said second bucket being adapted for removable connection to said attachment to further extend the distance from the loader at which loads may be lifted and placed.

7. The attachment as claimed in claim 6, said second bucket having a capacity for receiving flowable materials, in which said capacity is about six cubic feet.

8. The attachment as claimed in claim 6, said second bucket having opposed sides said opposed sides tapering in separation whereby flowable material is funneled as it is discharged.

9. The attachment as claimed in claim 1, said attachment member comprising an attachment plate adapted for removably coupling to a set of lift arms of a skid steer loader.

10. The attachment as claimed in claim 9, said attachment plate further comprising a downward angled upper flange and at least one downward angled pickup.

11. The attachment as claimed in claim 1, in which said acute angle is less than eighty degrees.

12. The attachment as claimed in claim 1, said bottom plate further comprising a fork assembly, said fork assembly comprising at least two flat tines each having a forward edge, said tine forward edges being beveled forwardly upwardly, said fork assembly extending generally outward away from said bottom plate to facilitate the handling of unit objects.

13. The attachment as claimed in claim 1, said bottom plate further comprising at least one grading bar, said grading bar having a forward edge, said grading bar forward edge being beveled forwardly upwardly.

14. The attachment as claimed in claim 1, further comprising a durable nonstick liner, said durable nonstick liner being removably securable within said bucket attachment to facilitate the hand mixing of materials therein.

15. An attachment for a power loader, adapted for lifting and placing loads at an extended distance from the loader, comprising:

an attachment member; and a working member operably coupled to said attachment member, said working member presenting a working member length extending generally outwardly away from said power loader in a digging direction when said attachment is coupled to said power loader, and a working member greatest width oriented generally orthogonal to said working member length, the working member having opposed sidewalls and said greatest width being defined as the distance between said opposed sidewalls at their widest separation;

said working member comprising a first bucket, said first bucket having a bottom plate and opposed side plates operably coupled to and extending upwardly from said bottom plate, and further comprising a second bucket, said second bucket being adapted for removable connection to said attachment to further extend the distance from the loader at which loads may be lifted and placed; and said working member length being not less than twice said working member greatest width, whereby, loads can be carried safely by said attachment and placed at an extended distance from said power loader.

16. The attachment as claimed in claim 15, said second bucket being removably connected to said attachment by fasteners selected from a group consisting of: threaded fasteners, nuts and bolts and a pin and collar assembly.

17. The attachment as claimed in claim 15, said second bucket having opposed sides said opposed sides tapering in separation whereby flowable material is funneled.

18. The attachment as claimed in claim 15, said second bucket having a capacity for receiving flowable materials, in which said capacity is about three cubic feet.

19. An attachment for a power loader, adapted for lifting and placing loads at an extended distance from the loader, comprising:

an attachment member; and a working member operably coupled to said attachment member, said working member presenting a working member length extending generally outwardly away from said power loader in a digging direction when said attachment is coupled to said power loader, and a working member greatest width oriented generally orthogonal to said working member length, the working member having opposed sidewalls and said greatest width being defined as the distance between said opposed sidewalls at their widest separation;

said working member comprising a first bucket, said first bucket having a bottom plate and opposed side plates operably coupled to and extending upwardly from said bottom plate, and further comprising a fork assembly, said fork assembly comprising at least two flat tines each having a forward edge, said tine forward edges being beveled forwardly upwardly, said fork assembly extending generally outward away from said bottom plate to facilitate the handling of unit objects; and said working member length being not less than twice said working member greatest width, whereby, loads can be carried safely by said attachment and placed at an extended distance from said power loader.

20. The attachment as claimed in claim 19, in which said fork assembly including said at least two flat tines is a single piece assembly.

21. An attachment for a power loader, adapted for lifting and placing loads at an extended distance from the loader, comprising:

an attachment member; and a working member operably coupled to said attachment member, said working member presenting a working member length extending generally outwardly away from said power loader in a digging direction when said attachment is coupled to said power loader, and a working member greatest width oriented generally orthogonal to said working member length, the working member having opposed sidewalls and said greatest width being defined as the distance between said opposed sidewalls at their widest separation;

said working member comprising a first bucket, said first bucket having a bottom plate and opposed side plates operably coupled to and extending upwardly from said bottom plate, and further comprising a sub-attachment, said sub-attachment comprising a bottom and a pair of separated opposed sides operably coupled to said bottom, said sub-attachment being adapted for removable connection to said attachment to further extend the distance from the loader at which loads of flowable material may be spread; and said working member length being not less than twice said working member greatest width, whereby, loads can be carried safely by said attachment and placed at an extended distance from said power loader.

22. The attachment as claimed in claim 2, said sub-attachment bottom further comprising a beveled forward edge and a beveled rearward edge whereby digging is facilitated.

23. An attachment for a power loader, adapted for lifting and placing loads at an extended distance from the loader, comprising:

an attachment member; and a working member operably coupled to said attachment member, said working member presenting a working member length extending generally outwardly away from said power loader in a digging direction when said attachment is coupled to said power loader, and a working member greatest width oriented generally orthogonal to said working member length, the working member having opposed sidewalls and said greatest width being defined as the distance between said opposed sidewalls at their widest separation;

said working member comprising a first bucket, said first bucket having a bottom plate and opposed side plates operably coupled to and extending upwardly from said bottom plate, in which said opposed side plates present a generally triangular shape; and said working member length being not less than twice said working member greatest width, whereby, loads can be carried safely by said attachment and placed at an extended distance from said power loader.

24. An attachment for a power loader, adapted for lifting and placing loads at an extended distance from the loader, comprising:

an attachment member; and a working member operably coupled to said attachment member, said working member presenting a working member length extending generally outwardly away from said power loader in a digging direction when said attachment is coupled to said power loader, and a working member greatest width oriented generally orthogonal to said working member length, the working member having opposed sidewalls and said greatest width being defined as the distance between said opposed sidewalls at their widest separation;

said working member comprising a first bucket, said first bucket having a bottom plate and opposed side plates operably coupled to and extending upwardly from said bottom plate, and further comprising at least one grading bar, said at least one grading bar having a forward edge, said grading bar forward edge being beveled forwardly upwardly; and said working member length being not less than twice said working member greatest width, whereby, loads can be carried safely by said attachment and placed at an extended distance from said power loader.

25. An attachment for a power loader, adapted for lifting and placing loads at an extended distance from the loader, comprising:

an attachment member; and a working member operably coupled to said attachment member, said working member presenting a working member length extending generally outwardly away from said power loader in a digging direction when said attachment is coupled to said power loader, and a working member greatest width oriented generally orthogonal to said working member length, the working member having opposed sidewalls and said greatest width being defined as the distance between said opposed sidewalls at their widest separation;

said working member comprising a first bucket, said first bucket having a bottom plate and opposed side plates operably coupled to and extending upwardly from said bottom plate, and further comprising a durable nonstick liner, said durable nonstick liner being removably securable within said bucket attachment to facilitate the hand mixing of materials therein; and said working member length being not less than twice said working member greatest width, whereby, loads can be carried safely by said attachment and placed at an extended distance from said power loader.

26. An attachment for a power loader, adapted for lifting and placing loads at an extended distance from the loader, comprising:

an attachment member, said attachment member comprising an attachment plate adapted for removable coupling to a set of lift arms of a skid steer loader, in which said attachment plate further comprises a safety bar extending generally upward therefrom to prevent lifted materials from passing over said attachment plate; and a working member operably coupled to said attachment member, said working member presenting a working member length extending generally outwardly away from said power loader in a digging direction when said attachment is coupled to said power loader, and a working member greatest width oriented generally orthogonal to said working member length the working member having opposed sidewalls and said greatest width being defined as the distance between said opposed sidewalls at their widest separation; and said working member length being not less than twice said working member greatest width, whereby, loads can be carried safely by said attachment and placed at an extended distance from said power loader.

* * * * *